US008966677B1

(12) United States Patent
Leihgeber

(10) Patent No.: US 8,966,677 B1
(45) Date of Patent: Mar. 3, 2015

(54) BABY BATH STATION

(71) Applicant: Joseph Q. Leihgeber, Williamsburg, OH (US)

(72) Inventor: Joseph Q. Leihgeber, Williamsburg, OH (US)

( * ) Notice: Subject to any disclaimer, the term of this patent is extended or adjusted under 35 U.S.C. 154(b) by 0 days.

(21) Appl. No.: 14/262,613

(22) Filed: Apr. 25, 2014

(51) Int. Cl.
*A47K 3/024* (2006.01)

(52) U.S. Cl.
USPC ..... 4/572.1

(58) Field of Classification Search
USPC ..... 4/572.1, 623, 624, 571.1
See application file for complete search history.

(56) References Cited

U.S. PATENT DOCUMENTS

| | | | | |
|---|---|---|---|---|
| 734,348 | A * | 7/1903 | Muehl | 4/626 |
| 3,192,537 | A * | 7/1965 | Coffman et al. | 4/516 |
| 4,084,270 | A * | 4/1978 | Kersten, Jr. | 4/615 |
| 5,465,438 | A | 11/1995 | Allman et al. | |
| 7,979,925 | B2 * | 7/2011 | Karbowski | 4/572.1 |
| 8,528,126 | B2 * | 9/2013 | Al-Mahnna | 4/626 |
| 2005/0044628 | A1 | 3/2005 | Rozental et al. | |
| 2007/0033730 | A1 | 2/2007 | Bean | |

* cited by examiner

*Primary Examiner* — Huyen Le
(74) *Attorney, Agent, or Firm* — Richard C Litman

(57) ABSTRACT

The baby bath station is a mobile bath and changing station for an infant. The station includes a wheel-supported housing having a bathtub therein. The tub has a downwardly sloping floor having a drain at the bottom. The drain empties into a wastewater holding receptacle. The receptacle is provided with converging funnel-shaped walls. The bottom of the holding receptacle is designed to be positioned over a conventional toilet for emptying. A bath water holding tank is positioned above the tub for containing warm bath water therein. A thermometer is mounted on the bath water tank to monitor the temperature of the bath water. A dispenser in the form of a shower head is attached to the bath water tank. The baby bath station is adapted for secure attachment to a kitchen sink for convenience and stability.

17 Claims, 3 Drawing Sheets

BABY BATH STATION

BACKGROUND OF THE INVENTION

1. Field of the Invention

The present invention generally relates to infant accessories, and particularly to a baby bath station that provides a mobile bathing/washing and changing station for a baby.

2. Description of the Related Art

Cleaning and bathing an infant can be an arduous task. Heretofore, this task has been performed in a conventional bathtub, a conventional bathroom basin, or a plastic container (tub) especially designed for bathing and cleaning an infant. These devices have proven to be less than adequate, since their use often requires the caregiver to bend or stoop in an awkward position, thereby making it difficult for the caregiver to maintain adequate control of a wiggling infant. Also, hygienic problems persist because there is no provision to separate infant excreta from the bath water. There are many apparatuses in the related art that have attempted to alleviate the aforementioned problems. None of the related art apparatuses, however, have proven to adequately solve these problems. The art would certainly welcome a mobile bathing apparatus that would effectively and efficiently address and alleviate the inadequacies of the related art. Thus, a baby bath station solving the aforementioned problems is desired.

SUMMARY OF THE INVENTION

The baby bath station is a mobile bath and changing station for an infant. The station comprises a wheel-supported housing having a bathtub therein. The tub has a downward sloping floor, which has a relatively large drain at the bottom thereof. The drain empties into a wastewater holding receptacle. The receptacle is provided with converging, funnel-shaped walls. A valve is positioned to control flow from the bottom of the wastewater holding receptacle. The bottom of the holding receptacle is designed to be positioned over a conventional toilet for emptying. A bath water holding tank is positioned above the tub for containing warm bath water therein. A thermometer is mounted on the bath water tank to monitor the temperature of the bath water. A dispenser in the form of a shower head is attached to the bath water tank. The changing station is adapted for secure attachment to a kitchen sink cabinet for convenience and stability.

Accordingly, the invention presents a unique bath and changing station that facilitates efficient bathing and changing of a baby. The bath and changing station is mobile to allow quick and easy movement thereof. Provision is made to effectively supply warm, clean water for bathing and to remove soiled water and possible baby excrement to enhance hygiene. The invention provides for improved elements thereof in an arrangement for the purposes described that are inexpensive, dependable and fully effective in accomplishing their intended purposes.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
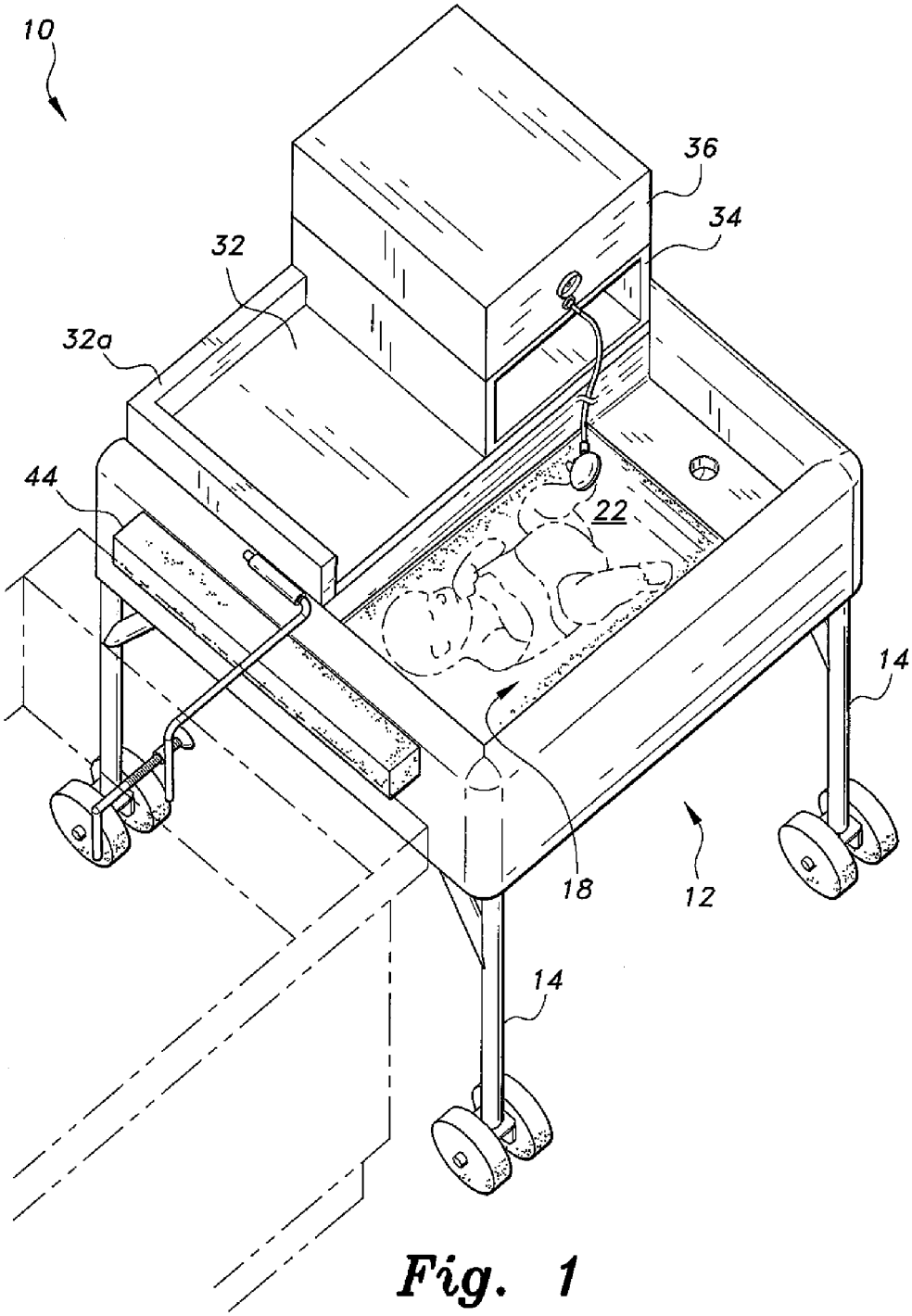
FIG. 1 is an environmental, perspective view of a baby bath station according to the present invention.
Figure 2:
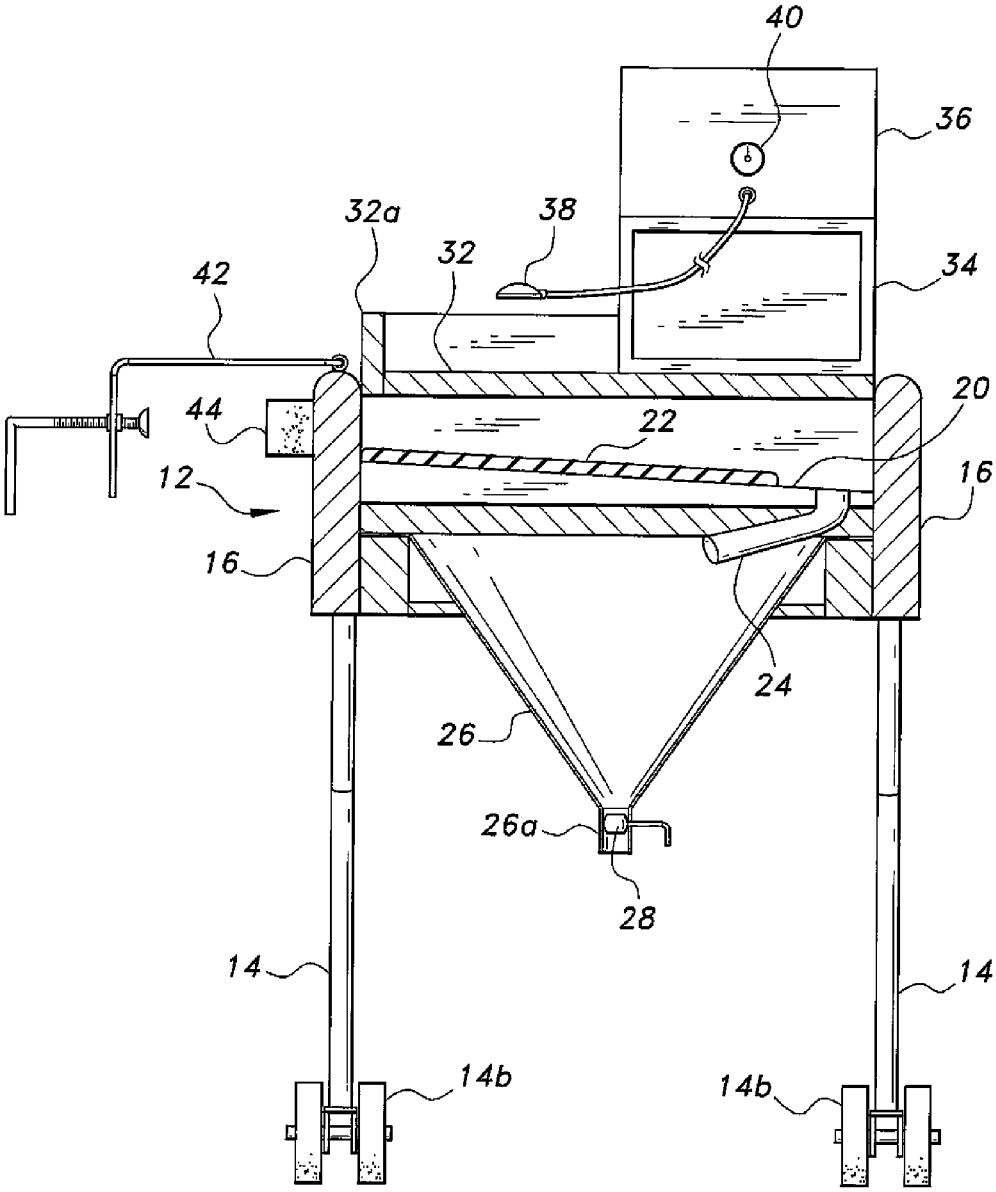
FIG. 2 is a side view in section of a baby bath station according to the present invention.
Figure 3:
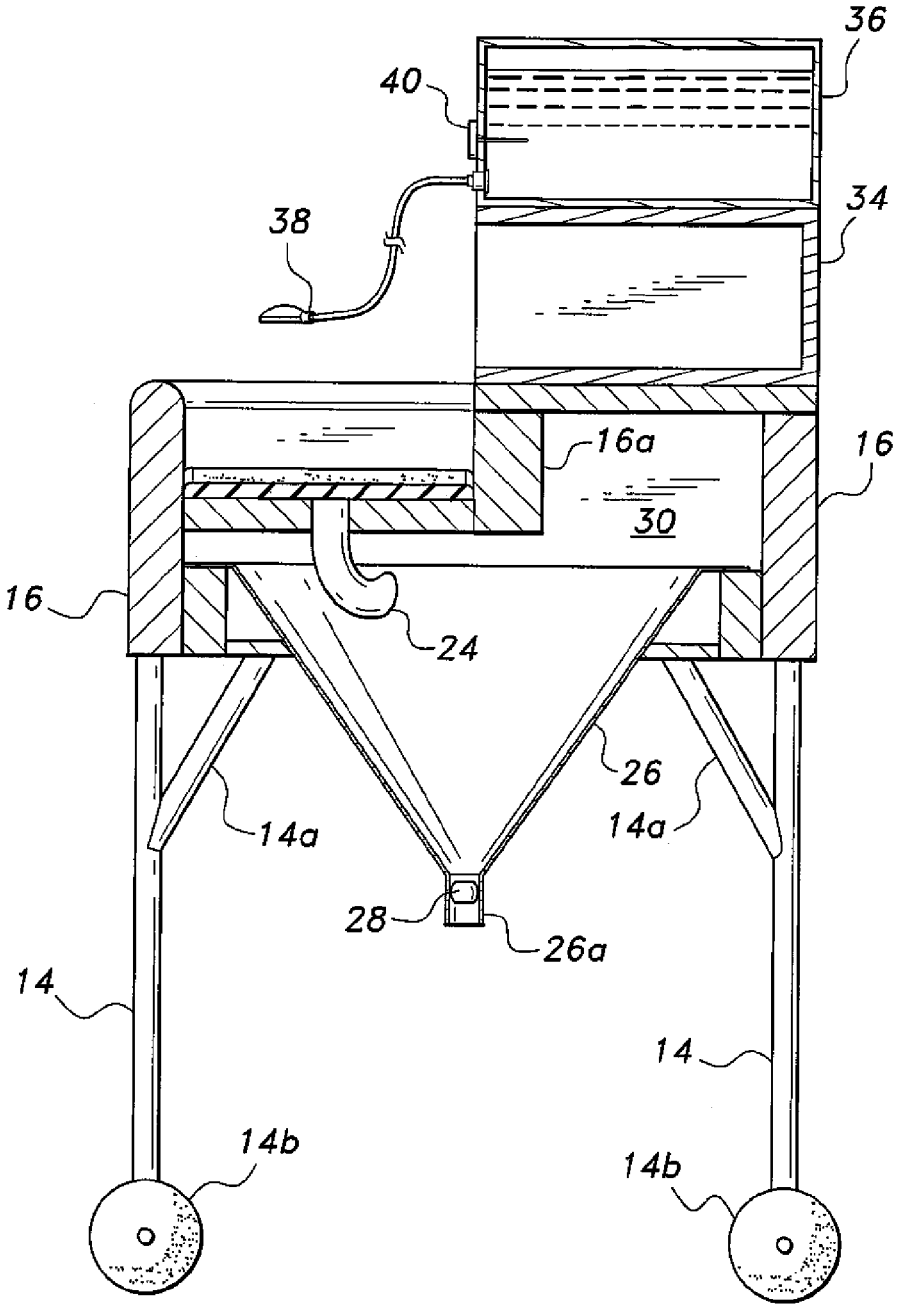
FIG. 3 is front view in section of a baby bath station according to the present invention.

Referring to FIGS. 1-3, the baby bath station is generally indicated at 10. The bath station 10 comprises a housing 12 mounted on legs 14 reinforced by braces 14*a*. Swivel casters 14*b* are mounted to the lower end of the legs 14. The legs 14 and braces 14*a* are preferably fabricated from steel. The housing 12 includes peripheral walls 16 that define an open area 18 having a bottom wall 20. The open area 18 functions as a tub for bathing or cleaning a baby. Although fiberglass or other plastic is preferred, it should be noted that the housing 12 may be fabricated from any suitable, non-toxic material. The bottom wall 20 slopes from side to side for reasons explained below. A removable air mattress 22 or the like rests on the upper surface of the bottom wall 20 to provide a comfortable support surface for the baby. A drain 24 is disposed at the one side of the bottom wall 20, the lateral slope of the bottom wall 20 directing wastewater to the drain 24 for removal by pulling a conventional drain plug. The drain 24 opens into a funnel-shaped receptacle 26. The receptacle 26 is suitably mounted to the housing 12 and receives wastewater from the tub via the drain 24. The drain 24 is sized (at least 2" diameter) to handle waste bath water and the baby's excreta. The receptacle 26 has an outlet opening 26*a* that can be opened or closed by manipulation of a valve 28. The bath station 10 is designed so that the outlet opening 26*a* is at least 16" above a horizontal surface or floor. This provides the outlet opening 26*a* with enough clearance to be positioned over a conventional toilet to dump wastewater therein. An opening 30 is disposed adjacent the tub area 18 and is separated therefrom by a transverse wall 16*a*. The opening 30 is closed by a removable panel 32. The opening 30 provides access to the wastewater receptacle 26 when the panel 32 is removed so that the receptacle 26 can be cleaned. Upstanding walls 32*a* are mounted on a portion of the upper surface of the removable panel 32, forming a tray for soap, towels, sponges, etc.

A shelf assembly 34 is removably positioned on the upper surface of the panel 32. The shelf assembly 34 is adapted to hold baby-bath paraphernalia (lotion, talc, oil, etc.). Mounted atop the shelf assembly 34 is water holding tank 36. The tank 36 contains warm, clean water for bathing the baby. A hose and shower head 38 are attached to the tank 36 and are adapted to provide gentle spray of water therefrom for bathing. A thermometer 40 is mounted on the tank 36 for monitoring the temperature of the water in the tank 36.

In use, the bath station 10 is moved to a position opposite a kitchen sink cabinet or the like (shown in phantom lines). A clamp mechanism 42 is employed to secure the bath station 10 to the kitchen sink cabinet, providing stability for the bath station 10. A rubber bumper 44 cushions the contact between the bath station 10 and the kitchen sink cabinet. Warm water is provided for the bathwater tank 36 by any suitable means. The thermometer 40 is utilized to insure that the water in the tank 36 is at a comfortable temperature for the baby. The valve 28 at the opening 26*a* is moved to a closed position and the mattress 22 is disposed on the bottom wall 20. The baby is now placed in the tub 18 for bathing utilizing spray from the tank 36 via the shower head 38. Wastewater flows through the drain 24 into the receptacle 26. After the baby is cleaned, dried and secured in a bassinette or the like, the bath station 10 can be wheeled to a position wherein the outlet 26*a* is disposed over a toilet. The valve 28 is opened and the wastewater flows from the receptacle 26 into the toilet. Removing the panel 32 will provide access to the receptacle 26 for cleaning.

It is to be understood that the present invention is not limited to the embodiments described above, but encompasses any and all embodiments within the scope of the following claims.

I claim:

1. A baby bath station, comprising:

a housing having a front wall, a rear wall, a pair of side walls, and a bottom wall connecting the walls, the housing defining a cavity;

a rubber bumper member disposed on said housing for cushioning against contact;

a plurality of legs attached to the housing for positioning the housing above a horizontal support surface, each of the legs having a lower end;

a receptacle mounted on the housing and disposed beneath the bottom wall;

a drain member connecting the cavity to the receptacle;

a shelf assembly mounted on the housing adjacent the cavity;

a tank for holding bath water disposed atop the shelf structure;

means connected to the tank for dispensing bath water therefrom; and a wheel connected to the lower end of each of the legs, whereby the housing can be easily moved.

2. The baby bath station according to claim 1, wherein said means for dispensing bath water includes a shower head and a hose having a first end attached to said tank and a second end, the shower head being mounted on the second end of the hose.

3. The baby bath station according to claim 1, further including a thermometer mounted to said tank for monitoring the temperature of the bath water.

4. The baby bath station according to claim 1, wherein said receptacle has downwardly converging, funnel-shaped inner walls defining a narrow outlet end.

5. The baby bath station according to claim 4, further including a valve disposed in said outlet end for opening and closing said outlet end.

6. The baby bath station according to claim 1, further including a clamp extending from said housing for securing said housing to a kitchen sink cabinet.

7. The baby bath station according to claim 1, further including a removable mattress disposed on the bottom wall of the cavity.

8. A baby bath station, comprising:

a housing having a front wall, a rear wall, a pair of side walls, and a bottom wall connecting the walls, the housing defining a cavity;

a plurality of legs attached to the housing for positioning the housing above a horizontal support surface, each of the legs having a lower end;

a caster connected to the lower end of each of the legs, whereby the housing can be easily moved;

a receptacle mounted on the housing and disposed beneath the bottom wall, the receptacle having downwardly converging funnel-shaped inner walls defining a narrow outlet end;

a drain member connecting the cavity to the receptacle;

a shelf assembly mounted on the housing adjacent the cavity;

a tank for holding bath water disposed atop the shelf assembly;

a thermometer mounted to the tank for monitoring the temperature of the bath water; and a shower head and a hose having a first end attached to the tank and a second end, the shower head being attached to the second end for dispensing the bath water therefrom.

9. The baby bath station according to claim 8, further including a valve disposed in the outlet end of said receptacle for opening and closing the outlet end.

10. The baby bath station according to claim 8, further including a clamp attached to one of the side walls of said housing for securing said housing to a conventional kitchen sink cabinet.

11. The baby bath station according to claim 8, further including a removable mattress disposed on the bottom wall of the cavity.

12. The baby bath station according to claim 8, further including a rubber bumper member disposed on a side wall of said housing for cushioning contact between said housing and a kitchen sink cabinet.

13. The baby bath station according to claim 8, wherein said drain has a diameter of at least two inches.

14. The baby bath station according to claim 8, wherein the narrow outlet end of said receptacle is positioned at a distance of at least sixteen inches above the casters.

15. A baby bath station, comprising:

a housing having a front wall, a rear wall, a pair of side walls, and a bottom wall connecting the walls, the housing defining a cavity;

a plurality of legs attached to the housing for positioning the housing above a horizontal support surface, each of the legs having a lower end;

a caster connected to the lower end of each of the legs, whereby the housing can be easily moved;

a removable mattress disposed on the bottom wall of the cavity;

a receptacle mounted on the housing and disposed beneath the bottom wall, the receptacle having downward converging funnel-shaped inner walls defining a narrow outlet end;

a valve disposed in the outlet end for opening and closing the outlet end;

a drain member connecting the cavity to the receptacle, the bottom wall of the housing sloping downward to the drain member;

a shelf assembly mounted on the housing adjacent the cavity;

a tank for holding bath water disposed atop the shelf assembly;

a thermometer mounted to the tank for monitoring the temperature of the bath water;

a shower head and a hose having a first end attached to the tank and a second end, the shower head being attached to the second end of the hose for dispensing the bath water therefrom;

a clamp attached to one of the side walls of the housing for securing the housing to a kitchen sink cabinet; and a rubber bumper member disposed on one of the side walls of the housing for cushioning contact between the housing and the kitchen sink cabinet.

16. The baby bath station according to claim 15, wherein the drain has a diameter of at least two inches.

17. The baby bath station according to claim 16, wherein the narrow outlet end of the receptacle is positioned at a distance of at least sixteen inches above said casters.

* * * * *